United States Patent [19]

Signorelli

[11] Patent Number: 4,468,895

[45] Date of Patent: Sep. 4, 1984

[54] SURFACE GRINDER ATTACHMENT

[76] Inventor: Gary J. Signorelli, 18781 Voiland, Roseville, Mich. 48066

[21] Appl. No.: 481,382

[22] Filed: Mar. 28, 1983

[51] Int. Cl.[3] ..... B24B 23/00

[52] U.S. Cl. ..... 51/168; 279/1 A

[58] Field of Search ..... 51/168, 389; 279/1 A

[56] References Cited

U.S. PATENT DOCUMENTS

| | | | |
|---|---|---|---|
| 972,575 | 10/1910 | Schramm | 51/168 |
| 1,577,467 | 3/1926 | Jeffries et al. | 51/168 |
| 2,919,521 | 1/1960 | Durney | 51/168 |
| 3,822,513 | 7/1974 | Holther | 51/168 |

FOREIGN PATENT DOCUMENTS

| | | | |
|---|---|---|---|
| 2831660 | 3/1979 | Fed. Rep. of Germany | 279/1 A |

*Primary Examiner*—Roscoe V. Parker

*Attorney, Agent, or Firm*—Charles W. Chandler

[57] ABSTRACT

An adapter which mounts on the spindle of a surface grinder spindle to support a small grinding wheel having a relatively small shank.

4 Claims, 4 Drawing Figures

SURFACE GRINDER ATTACHMENT

BACKGROUND OF THE INVENTION

This invention is related to surface grinders, and more particularly to an adapter that is mounted on the surface grinder spindle after the grinding wheel has been removed, to support the shank of a small grinding tool.

Surface grinders usually have a tapered spindle. The grinding wheel is mounted on the spindle and locked in position by a nut. In order to mount a small grinding tool having a shank, the conventional practice is to mount an attachment having a collet for supporting the grinding tool. The attachment is mounted on the spindle and has a pulley connected to the collet so that it rotates at a greater r.p.m. than the spindle. The grinding tool is mounted in the collet. The problem with this arrangement is that it is time consuming to remove the grinding wheel, and mount the attachment before the small grinding tool can be used.

SUMMARY OF THE INVENTION

The broad purpose of the present invention is to provide an adapter that can be quickly mounted on a surface grinder spindle for supporting the shank of a small grinding tool. In the preferred embodiment of the invention, which will be described in greater detail, the adapter has a body having a longitudinal bore. One end of the bore has a tapered configuration that can be readily mounted on the spindle of the surface grinder. The intermediate section of the bore is internally threaded to engage the threaded end of the spindle by rotating the adapter in the counterclockwise or left hand direction into the spindle. The outer end of the adapter has a small opening for receiving the shank of a grinding tool. A set screw on the adapter engages the shank to lock it into position. The adapter can be quickly and easily mounted on a conventional surface grinder spindle and is relatively inexpensive to manufacture.

Still further objects and advantages of the present invention will become readily apparent to those skilled in the art to which the invention pertains upon reference to the following detailed description.

DESCRIPTION OF THE DRAWINGS

The description refers to the accompanying drawing in which like reference characters refer to like parts throughout the several views, and in which.

DESCRIPTION OF THE PREFERRED EMBODIMENT

Figure 1:
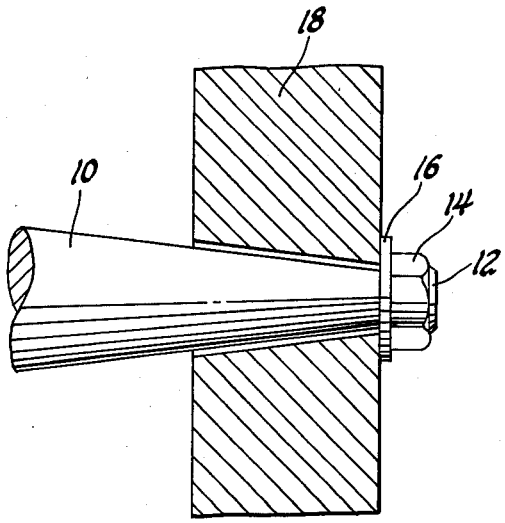
FIG. 1 is a sectional view of a surface grinder spindle having a conventional grinding wheel mounted thereon.

Referring to the drawing, a conventional surface grinder spindle is illustrated at 10 in FIG. 1. As well known to those skilled in the art, has a tapered configuration, usually about 7°. The extreme end of the spindle is threaded at 12 for receiving a nut 14 and a washer 16. A conventional grinding wheel 18 is mounted on the spindle.

Figure 2:
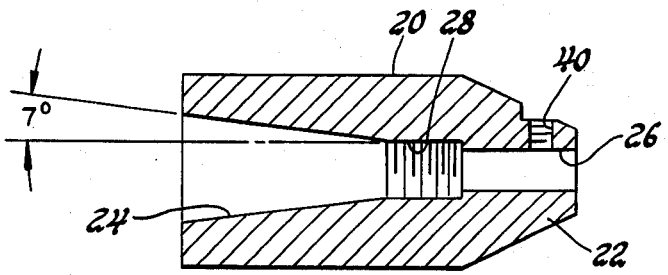
FIG. 2 is a longitudinal sectional view illustrating the preferred adapter.
Figure 3:
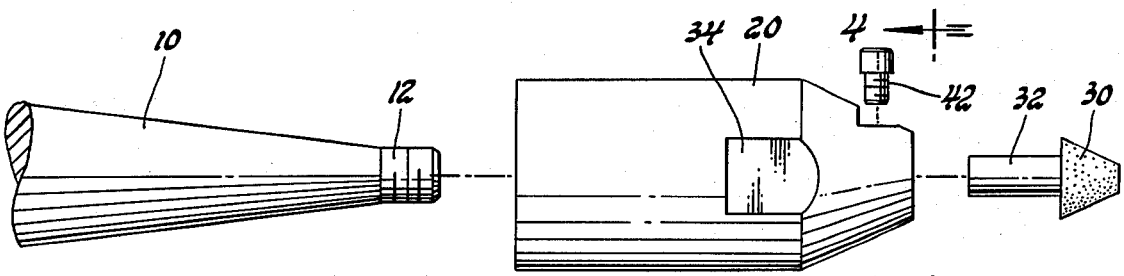
FIG. 3 is an exploded view showing the manner in which the adapter and grinding tool are mounted on the spindle.
Figure 4:
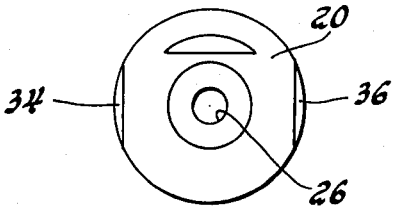
FIG. 4 is a view as seen along lines 4—4 of FIG. 3.

An adapter 20, illustrated in FIGS. 2–4, comprises an elongated body 22 having an internal, longitudinal bore 24. One end of the bore is formed with about a 7° taper with respect to the longitudinal axis of the body. The opposite end 26 of the bore has a $\frac{1}{4}$ inch diameter. The intermediate portion of the bore 28 is threaded to accommodate the threads of spindle end 12. The threaded portion is adapted to be mounted on spindle 10 by rotating the adapter in a left hand or counterclockwise direction to lock one end of body 20 on the spindle in the position from which grinding wheel 18 has been removed. A grinding tool 30 conventionally has a shank 32 receivable in opening 26 of the adapter.

The adapter has a pair of flat surfaces 34 and 36 on opposite sides of the body so that the user can fasten an open end wrench on the body to tighten it on spindle 10. The body also has a threaded opening 40 for receiving set screw 42 to engage shank 32 and lock it into position.

Thus it is to be understood that I have described an adapter that can be quickly and easily mounted on the spindle of a surface grinder after grinding wheel 18 has been removed in order to support a grinding tool having a shank.

I have described my invention I claim:

1. The combination comprising:

a surface grinder having an elongated, tapered spindle having an extreme end threaded for receiving a threaded fastener;

grinding wheel means removably mounted on the spindle, and fastener means mounted on the threaded end for preventing removal of the grinding wheel means;

a grinding attachment including an elongated body having a longitudinal bore having a first section of a first diameter adjacent one end of the body and opening thereto, a second section of a lesser diameter adjacent the opposite end of the body and opening thereto, and an intermediate section between said first and second sections;

the first section having a bore tapered to telescopically receive the tapered spindle, the intermediate section being internally threaded to threadably engage the threaded end of the spindle when mounted in a counterclockwise motion thereon at such times as the first grinding wheel is removed therefrom;

a grinding tool having a shank receivable into the second section of the longitudinal opening, and fastener means on the body for engaging the shank to prevent its rotation with respect to the body at such times as the spindle is being rotated.

2. A combination as defined in claim 1, in which the grinding tool has a smaller diameter than the grinding wheel.

3. A combination as defined in claim 1, in which the fastener means comprises a threaded fastener mounted on the body for engaging the shank of the grinding tool to prevent its rotation with respect to the body.

4. A combination as defined in claim 1, in which the third section has a longitudinal taper of about 7° with respect to the longitudinal axis of the body.

* * * * *